US006176116B1

(12) United States Patent
Wilhelm et al.

(10) Patent No.: US 6,176,116 B1
(45) Date of Patent: Jan. 23, 2001

(54) CRIMPING TOOL FOR CRIMPING LEAD END SLEEVES AND THE LIKE

(75) Inventors: Edgar Wilhelm, Altersbach; Horst Hofmann, Unterschoenau, both of (DE)

(73) Assignee: Rennsteig Werkzeuge GmbH, Viernau/Thueringen (DE)

( * ) Notice: Under 35 U.S.C. 154(b), the term of this patent shall be extended for 0 days.

(21) Appl. No.: 09/334,296

(22) Filed: Jun. 16, 1999

(51) Int. Cl.[7] ..... H01R 43/042

(52) U.S. Cl. ..... 72/409.12; 72/402; 81/313; 81/367; 81/427.5

(58) Field of Search ..... 72/409.12, 409.01, 72/402; 81/313, 427.5, 367

(56) References Cited

U.S. PATENT DOCUMENTS

| | | | | |
|---|---|---|---|---|
| 2,079,498 | * | 5/1937 | Douglas | 81/313 |
| 3,199,335 | | 8/1965 | Holmes et al. . | |
| 3,203,078 | | 8/1965 | Ustin . | |
| 3,330,148 | * | 7/1967 | Hornung | 72/409.12 |
| 3,459,029 | * | 8/1969 | Rosenfeld | 81/313 |
| 3,713,322 | * | 1/1973 | Fischer | 81/313 |
| 4,381,661 | * | 5/1983 | Wiener | 72/409.12 |
| 5,261,263 | | 11/1993 | Whitesell | 72/402 |

FOREIGN PATENT DOCUMENTS

| | | | | |
|---|---|---|---|---|
| 31 09 289 C2 | | 8/1987 | (DE) . | |
| 0 158 611 B1 | | 7/1990 | (EP) . | |
| 1342312 | * | 9/1963 | (FR) | 81/313 |
| 886259 | | 1/1962 | (GB) . | |
| 1 324 253 | | 7/1973 | (GB) . | |

* cited by examiner

*Primary Examiner*—Daniel C. Crane
(74) *Attorney, Agent, or Firm*—Michael J. Striker

(57) ABSTRACT

A crimping tool for crimping lead end sleeves, contact sockets, or plugs on the electrical conductors, two crimping jaws arranged in a tool head section for performing crimping, pivotably mounted and axially fixed in the tool head section, and forming a crimping aperature of adjustable cross-section, the crimping jaws on their outer peripheral surfaces receiving a pivot lever and are bringable into and out of a crimping position by a pivoting drive movement of the pivot lever, a toggle lever mechanism driven by the handles and effecting the pivoting drive movement of the pivot lever, for a force-stroke compensation between parts of a force transmission system, the crimping jaws in a region of their crimping profile being formed by a die surface and a sliding surface, the die surfaces of the crimping jaws forming a die profile of closed shape in all crimping position within an adjustable crimping range, the sliding surface of each of the crimping jaws being in planar contact with the die surface of an adjacent one of the crimping jaws, extending a plane of the adjacent die surface, the handles including a fixed handle formed as a compensating spring for force-stroke compensation between the parts of the force transmission system, and an elastic lever integrated and fixed in the fixed handle and mechanically linked with one lever arm of the toggle joint mechanism.

10 Claims, 2 Drawing Sheets

CRIMPING TOOL FOR CRIMPING LEAD END SLEEVES AND THE LIKE

BACKGROUND OF THE INVENTION

The present invention relates to a crimping tool for crimping lead end sleeves, contact sockets or lugs onto electrical conductors. More particularly it relates to a crimping tool which has crimping jaws which are arranged in the tool head section, are enclosed by a pivot lever and can be moved centrally relative to one another by the pivoting drive movement of the pivot lever effected by a toggle joint mechanism and thereby brought into and, on the return stroke, out of the crimping position. Its jaw surfaces partially abut in their active region form, together with the adjacent crimping jaws, a crimping aperture of adjustable cross section. An elastic compensation, automatically actuated during the crimping process and effected by springs, is created between parts of the force transmission system in order to compensate for differently dimensioned die profiles and the resulting variable crimping stroke.

The compensation of the respective crimping stroke produced by the differently dimensioned die profiles within the drive mechanics of the crimping tool existing between the handles and the crimping jaws is already necessary in order to guarantee the uniformity and quality of the crimping within a given size range of lead end sleeves and electrical conductors and in order to prevent breakage of tool parts by possible overloading. In this respect, it is particularly advantageous to provide this compensation in a resilient and elastic manner, e.g. by a spring element, which has been found in practice to considerably improve and facilitate the use of the crimping tools.

The crimping tool is ensured against possible premature opening of the crimping jaws by a pawl lock known in design and application. Once introduced, an operating stroke for the respective crimping is carried out in full in all cases.

In crimping tools with crimping jaws opening in a scissor-like manner, the compensation of crimping stroke differences has been effected in that only one of the mouth jaws is rigidly articulated. The other mouth jaw is articulated via an elastic zone, also in the form of a separate elastic element, to the associated handle with the interposition of the actuating member; e.g. a toggle lever mechanism (DE-PS 3109 289).

In contrast, in crimping tools designed according to the generic type, the compensation of the crimping stroke difference can be designed in such a manner that an elastically acting support, which is expediently formed by a separate elastic element, is arranged on at least one of the force transmitting elements (EP-PS O158 611). In this case, a toggle lever belonging to the force transmitting system is constructed at its outer hinged point so as to be displaceable against the action of a tension spring and is thereby able to adapt to a limited degree, together with a pawl lock, to the profile which is to be crimped. This type of indirect elastic support of the pivot lever accommodating the crimping jaws must be regarded as disadvantageous in many respects, since crimping errors which can occur in the degree of completion of the crimping can go unnoticed and therefore cannot be ruled out.

Crimping tools according to the generic features for crimping lead end sleeves onto electrical conductors have crimping jaws which are arranged in the tool head section, are enclosed by a pivot lever formed by the tool limb and can be displaced centrally relative to one another by the pivoting movement of the pivot lever. Thereby they can be brought into and out of the crimping position (U.S. Pat. No. 3,203, 078).

In this type of crimping tool, the pivot lever is brought into a drive connection with the crimping jaws via a splined shaft profile, and the pivot lever is accommodated and displaceable in a centring fashion on the outer peripheral surfaces of the crimping jaws. The crimping jaws are pivotably mounted and axially fixed to the lower base plate of one crimping tool part on through bearing pins.

Because of the type and shape of the die and also the design of the structural operating elements, the crimping tool proposed here is unsuitable for crimping lead end sleeves. The latter require crimping which is complete on all sides, is as uniform as possible over the entire cross section and has precise dimensions, which cannot be achieved using crimping tools of this type.

Further known tool designs for crimping electrical conductors are illustrated and described in U.S. Pat. No. 5,261, 263, U.S. Pat. No. 3,199,335, GB-PS 886,259 and GB-PS 1,324,253. These tool designs are also unsuitable for meeting the current demands of connecting or crimping technology in power electronics in terms of providing crimping which has shape precision, is non-destructive and secure. Furthermore, they are neither suitable for repeated crimping, nor are they simple and easy to handle. Whilst the structural operating features have been complicated in design and require relatively high technological outlay, it is also precisely these elements which impair the operating properties of these crimping tools as regards high operating position precision and a low degree of operational disturbance.

It is also true that multi-surface crimping tools of this type require very precise movement of the crimping jaws, particularly in the case of small and miniature crimping dimensions, for instance in the range below 1 $mm^2$, and therefore require a similarly precise drive or force transmission system and springing system between the displaced crimping tool parts.

To date, known designs of this type of crimping tool cannot fulfil the expectations in practice, or can only fulfil them to an unsatisfactory degree. It is these circumstances which have given rise to the purpose and object of the present invention.

SUMMARY OF THE INVENTION

The purpose of the invention is the further technological and operational perfection of the type of tool in question.

This gives rise to the object of the invention, which, in a crimping tool of this type, whilst essentially retaining a toggle lever for the drive of the pivot lever, is to improve and refine the kinematic system of the crimping jaws, to simplify and perfect the force-stroke compensation provided for application between the force transmission elements, and to construct the crimping jaws with a more effective die profile.

This object is attained according to the invention by a crimping tool for crimping lead end sleeves, contact sockets or lugs onto electrical conductors, having crimping jaws which are arranged in the tool head section, perform the crimping, are pivotally mounted and axially fixed in the tool head section on through bearing pins, jointly form a crimping aperature of adjustable cross section, are enclosed by a pivot lever which drives them, on their outer peripheral surfaces receive the pivot lever in a centring and drive-transmitting manner in a spline shaft profile, and can be brought into and out of their crimping position by the pivoting drive movement of the pivot lever effected by means of a toggle lever mechanism driven by handles.

The tool also has a force-stroke compensation, which is automatically effected, e.g. by springs, and is arranged between the handles and the crimping jaws, being created in the crimping tool between the parts of the force transmission system in order to compensate for crimping profiles of different dimensions and the resulting variable crimping stroke during the crimping process, the crimping jaws being formed in the region of their crimping profile by a die profile surface and a sliding surface in each case, and the die surfaces of all the crimping jaws forming a die profile of closed shape (e.g. a square or hexagon) in all crimping positions within their adjustable crimping range, to which purpose the rotational or pivot axis of the crimping jaws is defined by the median perpendicular formed by the straight line extending from the respective profile corner towards the profile center, together with the pitch circle chosen for the bearing pins, and the sliding surface of each crimping jaw being in planar contact with the die surface of the adjacent crimping jaw, extending the plane of the adjacent die surface, and the fixed handle being constructed as a compensating spring for force-stroke compensation between parts of the force transmission system by means of a reduction in its cross section in the form of a waist in its middle section, together with an elastic lever integrated and fixed in the handle and mechanically linked with one lever arm of the toggle joint mechanism.

In accordance with another feature of the present invention the crimping jaws have a profile on their die surface such that the crimped surfaces of the lead end sleeves are formed with a crimped profile that may be either circumferential or offset, the profile being formed by a basic triangular shape, whose profile points are rounded.

In accordance with still a further feature of present invention the elastic lever is constructed as part of the handle and has both a positive and friction connection with said handle at its rear end section by means of bolts and splines.

BRIEF DESCRIPTION OF THE DRAWINGS

The invention will be illustrated and explained in further detail in the following by way of an embodiment with the aid of the associated drawings, in which.

DESCRIPTION OF PREFERRED EMBODIMENTS

Figure 1:
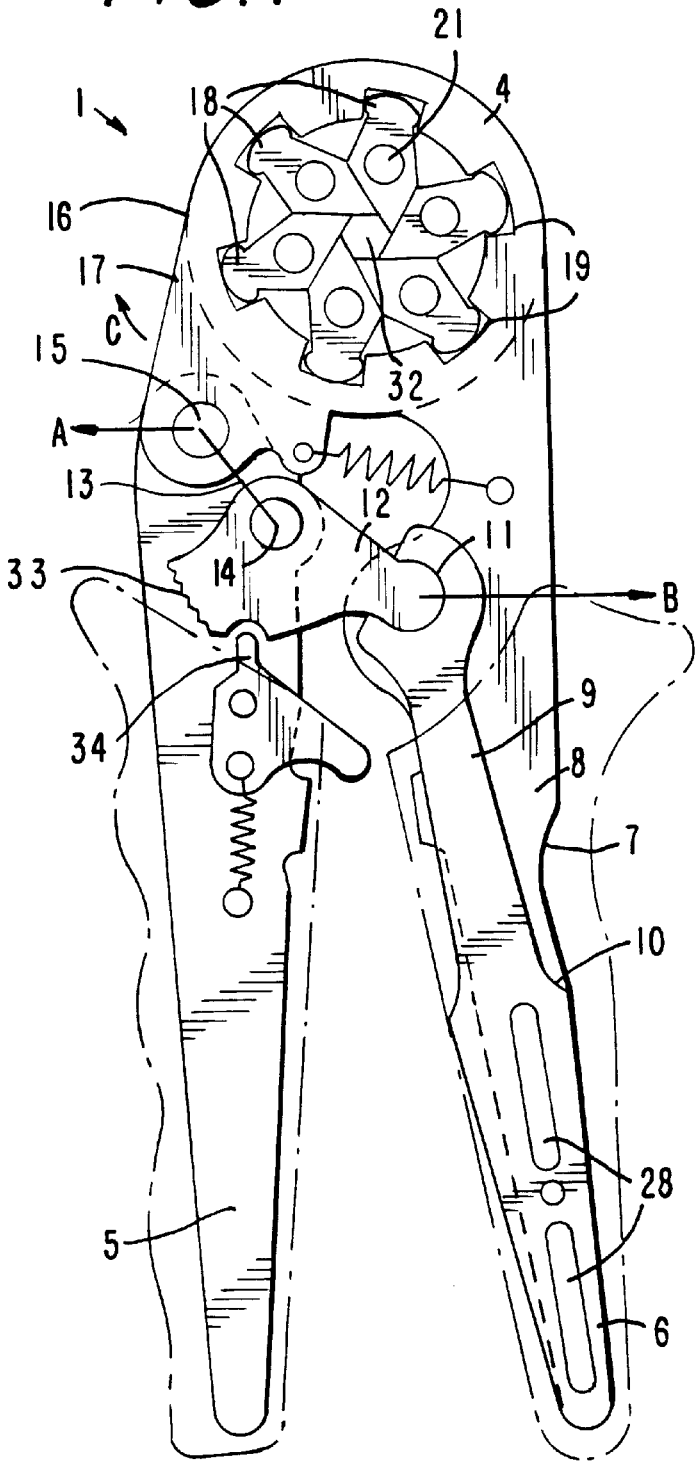
FIG. 1 is an overall view of the crimping tool with all fundamental operating parts.
Figure 2:
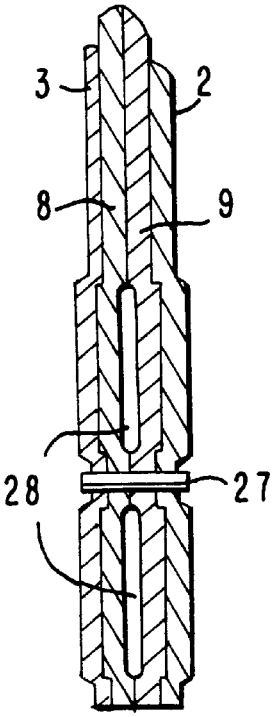
FIG. 2 is a detailed view for the construction of the spring elements shown as a partial section through the right-hand crimping tool handle.

The crimping tool 1 is constructed in known manner from two base plates 2, 3, which at one end form a head section 4 and at the other end handles 5 and 6. Formed in the right-hand handle 6 approximately in its middle section is an outer elastic zone 8, which is expediently created by a waist 7. It is capable of springing in and out relative to the adjacent head section 4 and the handle 5 when a corresponding force is applied, as will be described below.

Also arranged approximately in the same section is an inner or inwardly-lying spring 9. It is constructed as an elastic lever, is displaceably held at one of its ends and has a common hinge point 10 or clamping region 10 with the outer elastic zone 8 of the right-hand handle 6.

At its other freely projecting end, which is constructed as an open bearing seat 11, the spring 9 is connected in a positive-locking manner with a toggle lever 12. The latter is mounted in the left-hand handle 5 and, as shown in FIG. 1, belongs in a manner known in principle to a toggle lever mechanism, comprising the levers 12 and 13 and the handle 5, and forms the operative element of this crimping tool drive. The other of the two toggle levers, in this case bearing the reference numeral 13, is constructed between the common bearing point 14 and the bearing point 15, the latter belonging to the pivot lever 16 which is to be driven.

The pivot lever 16 is arranged between the two base plates 2 and 3 of the crimping tool body 1. It is connected for the drive action, as already mentioned, with the toggle lever mechanism at the bearing point 15 by means of a bracket 17 provided on the pivot lever 16. According to the invention, the pivot lever 16 is resiliently supported via the lever traction of the toggle lever against the elastic elements 8 and 9.

On its output side, the pivot lever 16 is connected to the crimping jaws 18 of the crimping tool. This connection is based on positive locking produced by a splined shaft profile 19. This detail is clearly shown in FIG. 1 and in particular in FIGS. 3 and 4. In this respect, it should be emphasized that whilst this arrangement of the pivot lever 16 is guided, it is otherwise freely displaceable.

As already proposed, the crimping jaws 18 are connected to the lower base plate 3 and pivotably mounted thereon with the aid of a through bearing pin 21.

Figure 3:
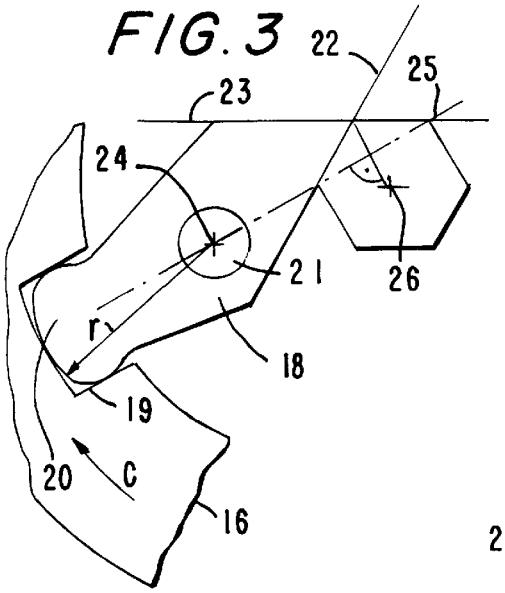
FIGS. 3 and 4 show the geometric relationships for constructing and arranging the crimping jaws and the kinematics thereof; in the case of hexagonal and square crimping.
Figure 4:
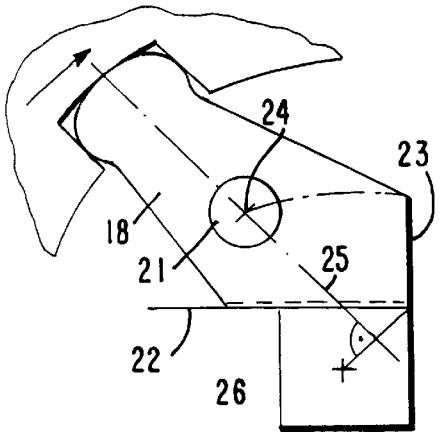
Figure 5:
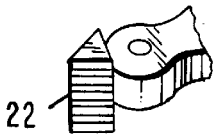
FIG. 5 shows a crimping jaw with a view of its die surface construction.

In this respect, the spatial arrangement, the mounting and the working profile of the crimping jaws 18 fulfil the following geometric requirements as part of the solution according to the invention:

The profile which is to be formed by the pivotable crimping jaws 18, as shown in the plane of the drawing, is formed in each case by the die surfaces 22, 23 lying adjacent one another. This is shown in FIGS. 3 and 4. The die surfaces 22 and 23 can be designed for polygonal crimping, preferably for square or hexagonal crimping. The geometric design and mechanical adjustment is effected in an entirely rosette-like manner, as shown in FIG. 1.

The pivot point 24 of the crimping jaws 18 lies in each case on the median perpendicular 25 which is formed between one of the corner points of the maximum crimping profile and the profile center point 26 thereof. In respect of the arrangement and mounting of the crimping jaws 18, it should also be noted that the distance of the bearing pins 21 from the profile center point in each case determines the degree of the transmission which is effective in this case and also the size of the crimping area.

In the embodiment of the present invention, the transmission ratio is preferably 1:1.

The two elastic elements 8 and 9, which according to the invention represent a new, simple and advantageous technical solution to the problem of compensating the different crimping areas which arises in crimping tools of this type are securely joined together in the rear end section of the right-hand handle 6. The joining is performed by transversely penetrating bolts 27 and longitudinally imprinted splines 28 and act in this region as a compact unit. This is important for the function and property of the springs 8 and 9 beyond their common hinge point 10.

Figure 6:
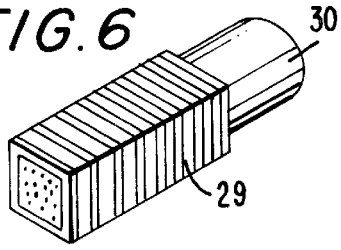
FIGS. 6 and 7 are schematic illustration of the possible types of crimping on lead end sleeves.
Figure 7:
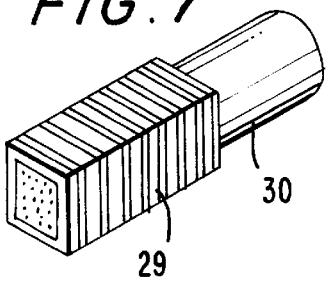
Figure 8:
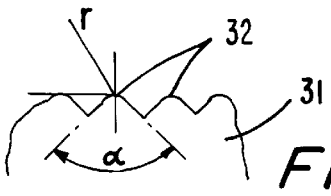
FIG. 8 is a partial cross section through the die profile of a crimping jaw.

Several further construction features determining the functional characteristic of this crimping tool lie in the design according to the invention of the crimping jaws 18. These are profiled on their actual die or crimping surfaces 22 in such a manner that either a circumferential crimping profile, as shown in FIG. 7, or an offset crimping profile, as shown in FIG. 6, is selectively formed on the crimped surfaces 29 of the lead end sleeves 30. The profile advantageously has a basic triangular shape 31, as indicated in FIG. a The profile points 32 are rounded.

The operation of the crimping tool in accordance with the present invention is as follows:

With the handles 5 and 6 open and the toggle levers 12, 13 tilted inwards, the crimping space 32 provided between the crimping jaws is also open. The parts which are to be crimped together can be introduced and brought into their crimping position.

In order to crimp the parts, the handles 5, 6 are closed. In so doing, the toggle lever 12, 13 is moved into its extended position "A–B" and thereby pivots the pivot lever 6 in the direction of the arrow "C" until the crimping jaws 18, which are also displaced under the influence of this pivoting movement via the splined shaft positive locking, reach their crimping position on the workpiece. With the further closure of the crimping tool handles 5, 6, the shaping crimping of the parts occurs. It continues until the toggle lever reaches its end position, just short of its extended position, and the pawl lock is overrun and therefore rendered inoperative, so that the crimping tool can open.

When crimping relatively large cross sections or generally when crimping cross sections of different sizes, it is necessary, given that the operating stroke of the handles and also of the toggle lever mechanism remains constant at all times, to effect a force-stroke compensation in the interior of the crimping tool.

As is known, this compensation is necessary so that the crimping tool can be closed over different-crimping cross sections using the usual manual force and also in order to release the action of the pawl lock.

This compensation in the force transmission system, which is expediently effected elastically, is provided by the springs 8 and 9, which optionally attempt to deflect in the direction of the arrow "B". Depending on the required force in the crimping zone 1 the spring characteristic curves of the two elastic elements can complement each other in a practical manner in order to guarantee complete shape-crimping on the parts and also to allow for a corresponding simple and pleasant handling of the crimping tool.

It will be understood that each of the elements described above, or two or more together, may also find a useful application in other types of constructions differing from the types described above.

While the invention has been illustrated and described as embodied in crimping tool for crimping lead end sleeves, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A crimping tool for crimping lead end sleeves, contact sockets, or plugs on the electrical conductors, comprising means forming a tool head section; two handles, two crimping jaws arranged in said tool head section for performing crimping, said crimping jaws being pivotably mounted and axially fixed in said tool head section through bearing pins on which said crimping jaws are pivotably mounted and axially fixed; said crimping jaws forming a crimping aperature of adjustable cross-section; a pivot lever for driving said crimping jaws, said crimping jaws on their outer peripheral surfaces receiving said pivot lever in a centering and drive-transmitting manner and are bringable into and out of a crimping position by a pivoting drive movement of said pivot lever; a toggle lever mechanism driven by said handles and effecting the pivoting drive movement of said pivot lever; means arranged between said handles and said crimping jaws for a force-stroke compensation between parts of a force transmission system in order to compensate for crimping profiles of different dimensions and resulting variable crimping stroke during a crimping process, said crimping jaws in a region of their crimping profile being formed by a die surface and a sliding surface, said die surfaces of said crimping jaws forming a die profile of closed shape in all crimping position within an adjustable crimping range, for which purpose a rotational axis of said crimping jaws is defined by a median perpendicular formed by a straight line extending from a respective profile corner toward a profile center, together with a pitch circle chosen for said bearing pins, said sliding surface of each of said crimping jaws being in planar contact with said die surface of an adjacent one of said crimping jaws, extending a plane of an adjacent die surface, said handles including a fixed handle formed as a compensating spring for force-stroke compensation between parts of the force transmission system by a reduction in its cross-section in form of a waist in a middle section to form an elastic zone in said fixed handle; and an elastic lever integrated and fixed in said handle, said elastic lever having one end hingedly connected with said fixed handle and another end mechanically linked with one lever arm of said toggle joint mechanism, said fixed handle and elastic lever operating as two elastic elements.

2. A crimping tool as defined in claim 1, wherein said crimping jaws on their outer peripheral surfaces receive said pivot lever in a spline shaft profile.

3. A crimping tool as defined in claim 2; and further comprising spring means arranged between said handles and said crimping jaws for automatically effecting the force-stroke compensation.

4. A crimping tool as defined in claim 1, wherein said die profile of closed shaped of said die surfaces of said crimping jaws is square.

5. A crimping tool as defined in claim 1, wherein said die profile of closed shaped of said die surfaces of said crimping jaws is hexagonal.

6. A crimping tool as defined in claim 1, wherein said crimping jaws have a profile on said die surface such that crimped surfaces of the lead end sleeves are formed with a crimped profile, said profile of said crimping jaws being formed by a triangular shape whose profile points are rounded.

7. A crimping tool as defined in claim 6, wherein said crimping jaws have such a profile on said die surface that the crimping profile formed on the lead end sleeves is circumferential.

8. A crimping tool as defined in claim 6, wherein said crimping jaws have such a profile on said die surface that the crimping profile formed on the lead end sleeves is offset.

9. A crimping tool as defined in claim 1, wherein said elastic lever is formed as a part of said fixed handle and has both a positive and a friction connection with said fixed handle at its rear end section.

10. A crimping tool for crimping lead end sleeves, contact sockets, or plugs on the electrical conductors, comprising means forming a tool head section; two handles, two crimping jaws arranged in said tool head section for performing crimping, said crimping jaws being pivotably mounted and axially fixed in said tool head section through bearing pins on which said crimping jaws are pivotably mounted and axially fixed; said crimping jaws forming a crimping aperature of adjustable cross-section; a pivot lever for driving said crimping jaws, said crimping jaws on their outer peripheral surfaces receiving said pivot lever in a centering and drive-transmitting manner and are bringable into and out of a crimping position by a pivoting drive movement of said pivot lever; a toggle lever mechanism driven by said handles and effecting the pivoting drive movement of said pivot lever; means arranged between said handles and said crimping jaws for a force-stroke compensation between parts of a force transmission system in order to compensate for crimping profiles of different dimensions and resulting variable crimping stroke during a crimping process, said crimping jaws in a region of their crimping profile being formed by a die surface and a sliding surface, said die surfaces of said crimping jaws forming a die profile of closed shape in all crimping position within an adjustable crimping range, for which purpose a rotational axis of said crimping jaws is defined by a median perpendicular formed by a straight line extending from a respective profile corner toward a profile center, together with a pitch circle chosen for said bearing pins, said sliding surface of each of said crimping jaws being in planar contact with said die surface of an adjacent one of said crimping jaws, extending a plane of an adjacent die surface, said handles including a fixed handle formed as a compensating spring for force-stroke compensation between parts of the force transmission system by a reduction in its cross-section in form of a waist in a middle section; and an elastic lever integrated and fixed in said handle and mechanically linked with one lever arm of said toggle joint mechanism, said elastic lever being formed as a part of said fixed handle and having both a positive and a friction connection with said fixed handle at its rear end section, said positive and friction connection being formed by bolt and splines.

* * * * *